US007199374B2

(12) United States Patent
Salvermoser et al.

(10) Patent No.: US 7,199,374 B2
(45) Date of Patent: Apr. 3, 2007

(54) CORONA DISCHARGE LAMPS

(75) Inventors: Manfred Salvermoser, Newark, NJ (US); Daniel E. Murnick, Bernardsville, NJ (US)

(73) Assignee: Rutgers, The State University, New Brunswick, NJ (US)

( * ) Notice: Subject to any disclaimer, the term of this patent is extended or adjusted under 35 U.S.C. 154(b) by 0 days.

(21) Appl. No.: 11/215,759

(22) Filed: Aug. 30, 2005

(65) Prior Publication Data

US 2006/0054821 A1 Mar. 16, 2006

Related U.S. Application Data

(60) Provisional application No. 60/605,991, filed on Aug. 30, 2004.

(51) Int. Cl.
*H01J 19/00* (2006.01)
*H01J 61/00* (2006.01)

(52) U.S. Cl. ..... 250/423 R; 250/424; 250/325; 313/231.71; 315/111.81; 315/111.91

(58) Field of Classification Search ..... None
See application file for complete search history.

(56) References Cited

U.S. PATENT DOCUMENTS 6,400,089 B1 * 6/2002 Salvermoser et al. ... 315/111.81

OTHER PUBLICATIONS

Salvermoser, M. and D. E. Murnick, "Efficient, stable, corona discharge 172 nm xenon excimer light source," J. Applied Physics, vol. 94, No. 6, Sep. 15, 2003, pp. 3722-3731.

* cited by examiner

*Primary Examiner*—Nikita Wells
(74) *Attorney, Agent, or Firm*—Lerner, David, Littenberg, Krumholz & Mentlik, LLP

(57) ABSTRACT

Excimers are formed in a gas (30,130) by applying a pulsed potential between a first electrode (14,114) and a counter electrode (26, 126) so that corona discharge occurs, substantially without arcing, when the potential is on. The pulses or on-times of the potential desirably are about 100 microseconds or less. Use of a pulsed potential provides greater efficiency than a constant potential. Where the excimer-forming gas is a pure inert gas, the gas desirably contains less than 10 ppm water vapor.

49 Claims, 3 Drawing Sheets

FIG. 1

CORONA DISCHARGE LAMPS

CROSS-REFERENCE TO RELATED APPLICATIONS

The present application claims the benefit of the filing date of U.S. Provisional Patent Application No. 60/605,991, filed Aug. 30, 2004, the disclosure of which is hereby incorporated by reference herein.

TECHNICAL FIELD

The present invention relates to corona discharge devices such as corona discharge lamps.

BACKGROUND OF THE INVENTION

An excimer is a short-lived molecule which typically consists of two atoms in an excited or high-energy state. An excimer may include atoms which will not normally bond with one another in the unexcited or ground state. As set forth in U.S. Pat. No. 6,400,089, ("the '089 patent") the disclosure of which is incorporated by reference herein, excimers can be generated efficiently by applying an electric field to a gas capable of forming excimers as, for example, noble gases and providing free electrons in the gas. For example, the field may be provided between a first electrode and a counter electrode immersed in the gas. The electric field is configured to accelerate electrons to at least the energy required to form excimers, but is configured so that in at least one region of the field, the field strength is below that required to substantially ionize the gas. Therefore, an arc does not form between the first electrode and the counter electrode. Such a non-arcing discharge is referred to as a corona discharge.

This arrangement can be used in creation of excimers for any purpose. One particularly useful application is in formation of excimers which emit electromagnetic radiation such as light upon decay of the excimers. For example, certain noble gas containing excimers will emit ultraviolet light upon decay. If the wall of the chamber is transparent or translucent to the light generated by decay of the excimers, the light can pass out of the chamber. Certain devices according to the '089 patent can provide intense ultraviolet light.

Despite the advance in the art represented by the '089 patent, still further improvement would be desirable.

SUMMARY OF THE INVENTION

One aspect of the present invention provides methods of forming excimers. A method according to this aspect of the invention desirably includes the step of imposing an electric field within a gas by applying a pulsed electric potential including pulses about 100 microseconds or less in duration between a first electrode within the gas and a counter electrode remote from the first electrode, so that free electrons pass from said first electrode toward said counter electrode, said electric field being configured so that during pulses of said pulsed electric potential (i) within a region of said field said free electrons have an electron energy distribution such that at least some free electrons have energies equal to or greater than the excitation energy required to form the excimer; and (ii) within a region of said field, said free electrons have an electron energy distribution such that a substantial majority of free electrons have energies less than the ionization energy of the gas. The free electrons excite the gas and form excimers without causing arcing.

A further aspect of the present invention provides apparatus for forming excimers. Apparatus according to this aspect of the invention desirably includes a chamber for holding an excimer-forming gas, a first electrode disposed within the chamber, and a counter electrode within the chamber remote from the first electrode. The apparatus most preferably includes a potential-applying circuit connected to the first electrode and to the counter electrode. The potential-applying circuit desirably is adapted to apply a pulsed potential between the electrodes so that during the pulses, imposes an electric field within the gas so as to provide free electrons and accelerate the free electrons. The electric field prevailing during the pulses desirably is configured so that during said pulses (i) within a region of the field the free electrons have an electron energy distribution such that at least some free electrons have energies equal to or greater than the excitation energy required to form the excimer; and (ii) within a region of the field, the free electrons have an electron energy distribution such that a substantial majority of free electrons have energies less than the ionization energy of the gas. Most preferably, the potential-applying circuit is arranged to apply said pulses so that at least some of the pulses are about 100 microseconds or less in duration.

The foregoing aspects of the invention incorporate the realization that the significant increases in the efficiency of conversion of power to excimer formation and, consequently, increases in efficiency of conversion of applied power to light can be achieved by applying a pulsed electric potential between the first electrode and the counter electrode. Preferably, the pulses are of a short duration, desirably about 100 microseconds or less, and the pulsed potential has a duty cycle such that the potential is on about 75 percent or less of the total time, more desirably about 50 percent or less of the total time, and most desirably about 25% or less of the total time.

In general, further reductions in duty cycle tend to increase the efficiency and, all else being equal, the excimer formation and light output per unit time during the pulse on-times. Although the present invention is not limited by any theory of operation, it is believed that this phenomenon relates to differences in temperature of the first electrode. It is believed that the first electrode remains cooler with pulsed excitation than with continuous excitation.

A further aspect of the invention incorporates the discovery that, in systems using noble gases (He, Ne, Ar, Kr, and Xe) to form excimers of the noble gases (e.g., $Xe_2$*) certain impurities dramatically reduce the overall efficiency of excimer formation. In particular, these impurities include species which will form electronegative ions under the conditions prevailing in the system. Water vapor, ($H_2O$) is one such species. Other species which form negative ions under these conditions to a substantial extent include halogen containing species, other oxygen containing species such as $CO_2$ and halogen-containing species. Thus, a further aspect of the invention provides methods of forming excimers in a gas, most preferably a gas including one or more noble gases. The method according to this aspect of the invention desirably includes providing free electrons in a gas; and imposing an electric field within the gas so as to accelerate said free electrons. In this aspect of the invention as well, the electric field desirably is configured so that (i) within a region of said field said free electrons have an electron energy distribution such that at least some free electrons have energies equal to or greater than the excitation energy required to form the excimer; and (ii) within a region of said field, said free electrons have an electron energy distribution such that a substantial majority of free electrons have energies less than the ionization energy of the gas. Here again, the free electrons excite the gas and form excimers without causing arcing. In the methods according to this aspect of the invention, the gas desirably contains less than about 10 ppm of impurities capable of forming negatively-charged ions in the aforesaid regions of the electric field, and most preferably contains less than about 10 ppm of water vapor.

These and other objects, features and advantages of the present invention will be more readily apparent from the detailed description set forth below, taken in conjunction with the accompanying drawings.

DETAILED DESCRIPTION

Figure 1:
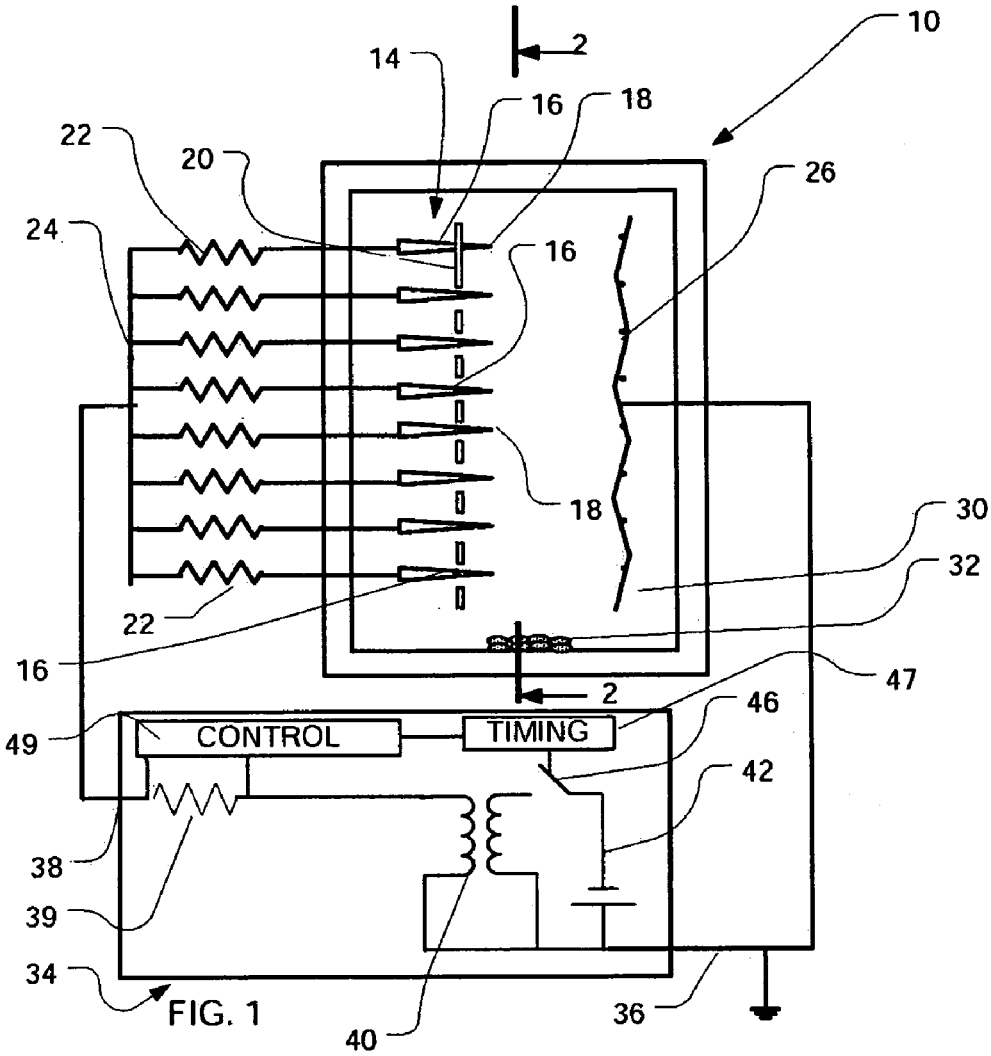
FIG. 1 is a block diagram of apparatus according to one embodiment of the invention.
Figure 2:
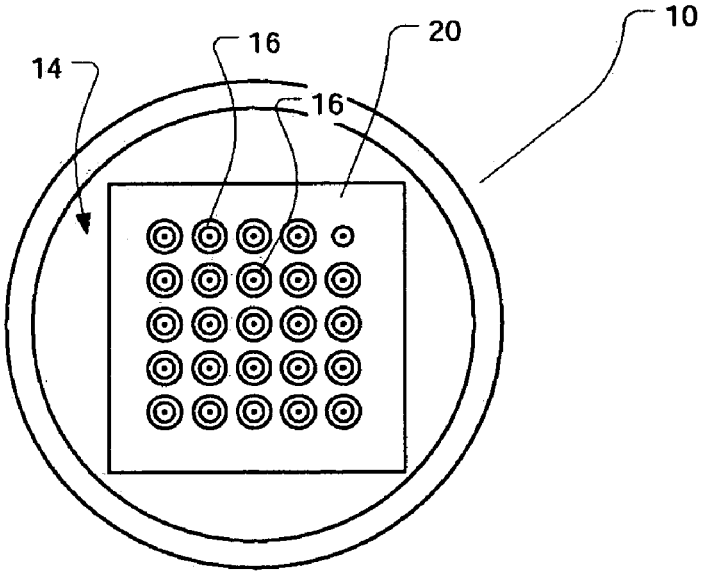
FIG. 2 is a sectional view taken along line 2—2 in FIG. 1.
Figures 4, 5:
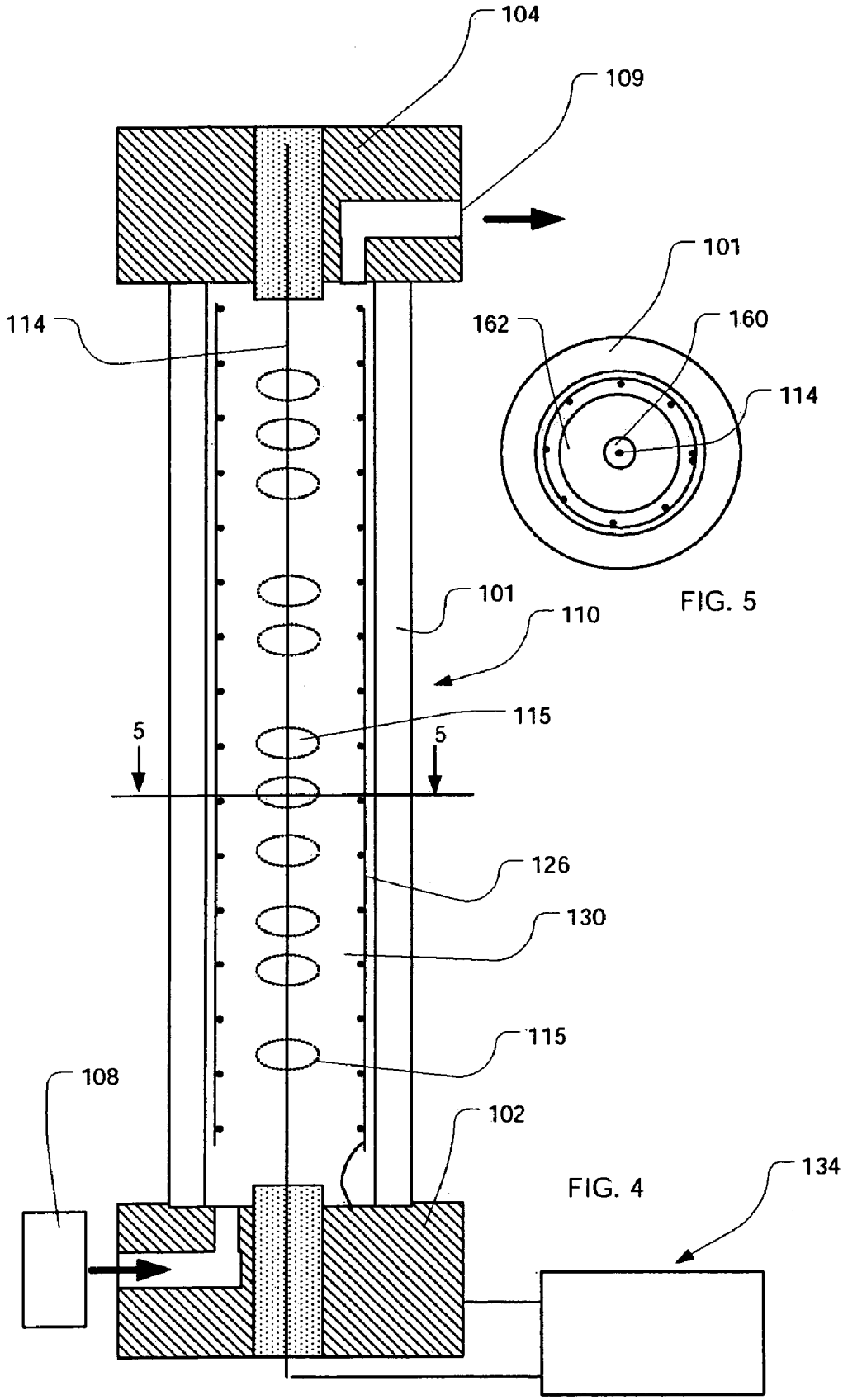
FIG. 4 is a diagrammatic sectional view depicting apparatus according to a further embodiment of the invention.
FIG. 5 is a sectional view taken along line 5—5 in FIG. 1.

Certain features of the unit depicted in FIGS. 1 and 2 are also shown at FIG. 5 of an article by the present inventors entitled "Efficient, stable, corona discharge 172 nm xenon excimer light source," Journal of Applied Physics, Volume 94, Number 6, pages 3721–3731 (hereinafter "J. Appl. Phys. 2003"). The entire disclosure of such article is incorporated by reference herein.

Apparatus in accordance with one embodiment of the present invention includes a chamber 10 having some of the walls formed from a material transparent to ultraviolet light at 172 nm wavelength, most preferably fused silica. A first electrode 14 is disposed within the chamber. The first electrode includes plurality of needles 16 having tips 18 disposed substantially in a plane. The needles desirably are formed from a metallic material such as tungsten and have sharp tips. The first electrode further includes a metallic plate such as a copper plate 20 connected to one of the needles 16 and extending around the other needles, but not touching the other needles. Plate 20 may be positioned about 1 mm behind the plane of tips 18. Each needle 16 optionally may be associated with an individual ballast resistor 22. Each needle may be connected through its associated ballast resistor 22 to a common bus 24. Each ballast resistor may have resistance on the order of 1 kilo ohm. As further explained below, the ballast resistors are optional; the needles 16 may be connected directly to bus 24.

A counter electrode 26 in the form of a metallic screen or plate is also positioned within chamber 10. The distance between the plane of needle tips 18 and the counter electrode may be, for example, about 0.7–1 cm.

The interior of chamber 10 is filled with an excimer-forming gas 30. Gas 30 desirably is a high-purity gas, as further discussed below. In the particular embodiment illustrated, gas 30 is high-purity Xe. The gas desirably is at a pressure of about 0.5 atmospheres or above, more preferably about 1 atmosphere or above. A small amount of a desiccant or getter 32 is provided within chamber 10. The desiccant or getter serves to react with impurities such as water vapor, oxygen, carbon dioxide and other species capable of forming negative ions under the conditions prevailing within the chamber during operation. Materials suitable for use as a getter include those commonly used as getters in vacuum tubes, as for example, molecular sives, zeolites or highly purified barium, zirconium, or titanium.

A pulsing power supply 34 is connected to the common bus 24 of the first electrode and to the counter electrode 26. Power supply 34 has a ground connection 36 connected to the counter electrode 26, and has a high-voltage output connection 38 connected to the common bus 24 of the first electrode. The power supply 34 is symbolically shown as incorporating a transformer 40 having a primary side connected to a low-voltage primary circuit 42 through a switching element 46 and having a high-voltage or output side connected to an output connection 38 through a low-value current sensing resistor 39. Although the switching element 46 is depicted as a simple switch, it typically incorporates solid-state switching elements such as transistors, and is controlled by a timing circuit 47 so that the switch periodically closes and opens. When the switch is closed, a magnetic field builds in the transformer. When the switch is opened, the magnetic field suddenly collapses, inducing a high voltage at output connection 38, and hence at the needles 16 of the first electrode. A control circuit 49 detects the voltage across sensing resistor 39 and thus detects the current passing through output connection 38 and through first electrode 14. The control circuit is arranged to inhibit operation of timing circuit and thus prevents application of further high-voltage pulses on output connection 38 for a short time such as 0.1–1.0 sec if the current exceeds a preselected threshold during a pulse. It should be appreciated that the depiction of the power supply 34 is merely schematic, and that the power supply 34 may include other elements commonly found in conventional high-voltage switching power supplies. The power supply is arranged so that the voltage appearing at output connection 38 is negative with respect to ground.

The power supply and other elements of the circuit connecting the power supply to the electrodes desirably are constructed and arranged so that each pulse or "on" interval of the negative voltage applied to the first electrode 14 has a duration of about 100 microseconds or less, and so that the rise time of the voltage at the inception of each pulse is about 10 microseconds or less, as further discussed below. As used herein, the term "rise time" refers to the time for the negative voltage to rise from about 10% of its maximum magnitude to about 90% of its maximum magnitude. The negative voltage at the first electrode typically has a duty cycle of about 75% or less, and more typically about 50% or less. Lower duty cycles, desirably about 25% or less or 5% to about 15%, such as about 10%, can be used. As used herein, the term "duty cycle" refers to the percentage of the total elapsed time that the voltage is on.

Figure 3:
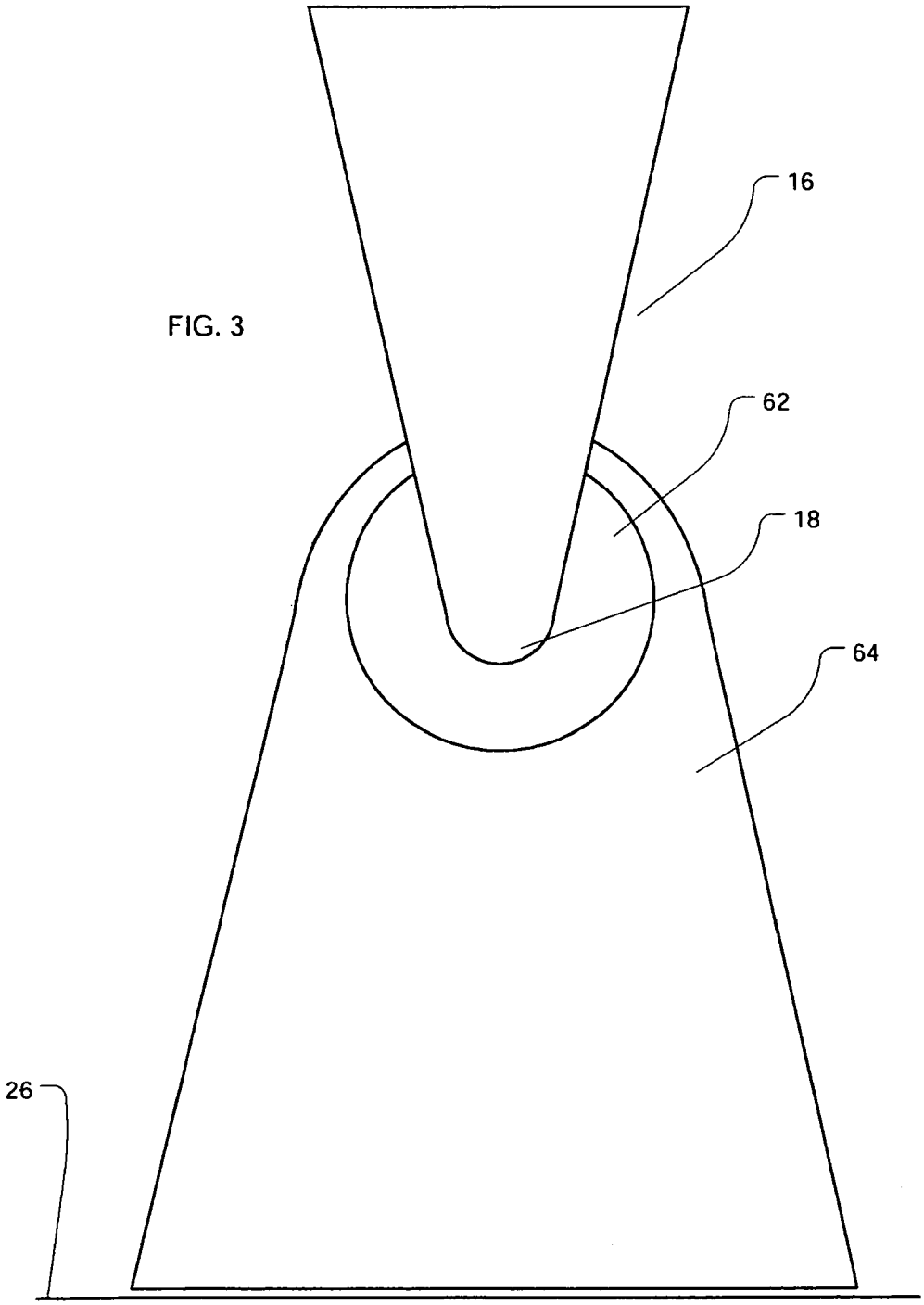
FIG. 3 is an idealized view depicting a portion of the apparatus shown in FIGS. 1 and 2 on an enlarged scale.

While the first electrode is at a negative potential with respect to the counter electrode, the high negative voltage applied to the tips 18 of the needles 16 creates a high intensity electric field around the tips and between the tips and the counter electrode. One tip is depicted in FIG. 3 in idealized form. The field strength is highest immediately adjacent the tip. In the immediate vicinity of the tip, the field strength decreases with the square of the distance r from the tip. Within an inner, generally spherical region 60 of the field, from the tip to a given radius $r_{inner}$, the field strength is sufficient to cause appreciable ionization of the gas, which yields free electrons. Within this region, the free electrons may be accelerated to a mean energy near to or higher than the ionization energy $\epsilon^{ion}$ of the gas. Within this region, the gas is at a high temperature and excimer formation is minimal. Stated another way, a localized corona discharge occurs within the inner region. Under the influence of the electric field, free electrons move toward the counter electrode and pass out of the inner region to an outer region 62, which extends from the inner region to the counter electrode 26.

In the outer region 62, the field is substantially lower than in the inner region, and is nearly uniform. In this outer region 62, the free electrons are accelerated to a mean energy well below the ionization energy $\epsilon^{ion}$ of the gas, so that a substantial preponderance of the electrons have energies below the ionization energy of the gas. However, a significant proportion of the electrons have energies above the electron excitation energy $\epsilon^*$ of the gas atoms. In this region, a substantial proportion of the gas atoms are promoted to electronically excited states by energy transferred from the free electrons. These excited atoms form excimers. Thus, substantial excimer formation occurs in this region.

Formation of excimers increases with the field strength in the outer region 62, and thus increases with the applied voltage. This can be understood qualitatively as follows: As the applied voltage and the field strength in the outer region increases, the distance through with an electron must accelerate within the field to reach $\epsilon^*$ decreases. In passing from the inner region to the counter electrode, a particular electron will accelerate to $\epsilon^*$ or above, then excite a gas atom and then accelerate again to and excite another atom. These steps are repeated until the electron reaches the counter electrode 26. The number of excited gas atoms formed per electron is inversely related to the acceleration distance required to reach $\epsilon^*$. Thus, for a given system, the number of excimers formed per electron increases with the field strength and thus with the applied potential.

The upper limit on field strength and applied potential is imposed by the need to avoid or limit arcing. The electrons in the outer region of the field have a range of energies. Even where the mean energy of the electrons is below the energy $\epsilon^{ion}$ required to ionize a gas atom, some of the electrons have energy approaching $\epsilon^{ion}$. Where the number of electrons having energy equal to or above $\epsilon^{ion}$ exceeds a threshold value, arcing will occur. For any given system, the applied potential and field strength which causes significant arcing can be determined experimentally, and the applied potential during each pulse can be set just below this limit. The voltage applied during each pulse can be selected by configuring the power supply 34. To facilitate adjustment of the voltage, the transformer 40 may be a variable transformer.

Moreover, the relationship between applied potential and electron energy distribution can be calculated as described further in the aforementioned J. Appl. Phys. 2003 article. One measure of the field is referred to herein as the reduced field. The reduced field is equal to the field strength E (in kV/cm) divided by the gas pressure (in bar). For Xe, operation at a reduced field of about 1 kv/(cm bar) to about 3 kV/(cm bar), and preferably about 3 kv/(cm bar), during the on-times of the pulsed potential generally provides good efficiency without arcing. For Xe, $\epsilon^{ion}$ is approximately 12.1 eV, whereas $\epsilon^*$ is approximately 8.32 eV.

The use of a pulsed potential with relatively short pulse duration or on-time, such as 100 μs or less, provides significant benefits. For a given system, the potential which can be applied during the on-times of such a pulsed potential without arcing is significantly greater than the continuous potential which can be applied without arcing. Therefore, the system using a pulsed potential can operate at a higher potential, and hence higher efficiency, than a comparable system using a constant potential. Also, where the first electrode includes needles or other structures defining a plurality of points (as in FIG. 1), applying the potential in short pulses with rapid rise time tends to prevent concentration of the current in a single needle. Here again, the present invention is not limited by any theory of operation. However, it is believed that this effect results from the finite drift time of electrons and/or ions in the gas. Regardless of the reasons for this effect, it provides significant benefits. In a mutlineedle electrode, the ballast resistors serve to prevent arcing at a single needle. However, with pulsed excitation as discussed herein having short rise times, the ballast resistors may be omitted or may have relatively low resistance, thereby increasing the overall efficiency of the system.

Even shorter pulse lengths, with even more rapid rise times, tend to maximize the benefits discussed above. For example, the pulse length may be about 50 μs or less, or about 25 μs or less, or about 10 μs or less, such as about 1 μs to about 15 μs or about 10 μs to about 15 μs. The pulse length, as referred to herein, is the total length of the pulse, including the rise time at the inception of the pulse and the fall time at the end of the pulse. The rise time at the inception of each pulse desirably is about 10% of the pulse length or less. For example, for a pulse length of 10 μs or less, the rise time desirably is about 1 μs or less.

The current through the electrodes, and hence through sensing resistor 39, typically is in the range of a 100 milliamperes or less during each pulse, and zero during the intervals between pulses. The current averaged over the total operating time, including both pulses or "on" time and intervals between pulses or "off" time is referred to herein as the "time average current", and is most typically in the range of 1 mA to several mA. In the event arcing occurs during a particular pulse, the current through the electrodes increases to many times the level observed during a normal pulse, as, for example, several hundred mA. Control circuit 49 responds to this increase by commanding the timing circuit to leave switching element 46 open for a short interval, desirably equal to a few normal cycles. During this time, the ionized species formed in the arc dissipate and the electrodes cool. Normal operation can then be resumed. The control circuit thus allows operation at pulse voltages very close to the threshold at which arcing occurs, and contributes to the efficiency of the system. In further variants, the control circuit is arranged to control the voltage applied during each pulse, as by increasing the voltage when arcing is absent and decreasing it when arcing is present, so that the system will settle to a pulse voltage just below the threshold at which arcing occurs.

For typical systems, the potential source should be capable of applying the pulsed potential so that during each pulse, the first electrode is at about 1 kV to about 20 kV negative voltage with respect to the counter electrode. The optimum voltage will vary with factors such as the gas pressure, gas purity and the distance between the first electrode and the counter electrode. This distance typically is in the range of about 10 mm to a few centimeters. Most typically, the gas pressure is in the range of about 0.2 bar to about 10 bars. The product of gas pressure times inter-electrode distance typically is on the order of 0.1 bar*cm to 20 bar*cm.

Apparatus according to a further embodiment of the invention, depicted in FIGS. 4 and 5, includes a chamber 110 having a tubular wall 101 formed from a material such as fused silica transparent to the ultraviolet light which will be emitted during operation and end caps 102 and 104. The apparatus further includes a first electrode 114 in the form of an elongated small-diameter metallic wire and a tubular counter electrode 126 in the form of a metallic screen coaxial with the wire first electrode and hence disposed at a uniform distance from the wire first electrode. The first electrode or wire 114 may be physically supported by the end caps 102 and 104, but is electrically insulated from the end caps. The counter electrode 126 may be connected to ground potential through one or both of the end caps. A potential application circuit including a switched power supply 134 is electrically connected between the first electrode 114 and the counter electrode. The potential application circuit is arranged to apply a switched or pulsed negative potential to the first electrode 114 in substantially the same manner as discussed above. In this embodiment, the excimer-forming gas 130 is supplied continuously from a source 108 so that it passes through chamber 110 and exits through a port 109. Alternatively, the chamber may be sealed with the excimer-forming gas permanently contained within the chamber. A getter (not shown) may be provided in the chamber or in the gas source, or both. During normal operation, the power dissipation within the chamber is moderate, and hence heat dissipation through the chamber walls to normal room air maintains the chamber at a reasonable temperature, typically less than 50° C. However, additional cooling means (not shown) may be provided; these may include coolant passages in the chamber walls, end caps or electrodes.

In operation, when the negative potential is applied to the wire first electrode 114, it tends to produce a set of discrete light emission zones along the length of the wire. Although the present invention is not limited by any theory of operation, it is believed that these emission zones form at locations where factors such as minor irregularities in the surface of the wire produce local concentrations in the electric field in the vicinity of the wire. As the applied voltage increases, the number of emission zones also increase. Each emission zone includes field regions similar to those discussed above with reference to FIG. 3. Thus, each emission zone includes an inner region 160 in which a substantial proportion of the electrons have energies above that required for ionization and an outer region 162 in which all or almost all of the electrons have energies below that required for ionization but many electrons have energy above that required for excimer formation. In this embodiment, field is substantially radial and the regions 160 and 162 are generally cylindrical.

In one example, the tubular embodiment shown in FIGS. 4 and 5 includes a tubular chamber about 4 cm outside diameter. In the condition depicted in FIGS. 4 and 5 a voltage of several kV as, for example, about 2.3 kV to about 6 kV is applied in pulsed fashion and produces a time average current of about 1 milliampere to a few milliamperes. The chamber may contain any of the gases discussed herein as, for example, Xe at a pressure of about 1 bar.

As discussed above, the pulsed potential source is arranged to apply the pulses so that the potential rises rapidly at the inception of each pulse. In this embodiment, the rapid rise time tends to minimize concentration of the current at one or more points along the length of the wire.

The applied potential between the first electrode and the counter electrode may include a component in addition to the pulsed excitation discussed above. For example, a DC component may maintain the first electrode at a negative voltage with respect to the counter electrode during intervals between pulses. In one such arrangement, the first electrode is maintained at one negative potential (e.g., −1 kV) with respect to the counter electrode during intervals between pulses, and at a greater negative potential (e.g., −3 kV) during pulses. In other arrangements, the additional component may include a reverse-polarity DC component or a slowly varying AC component.

The features discussed above can be applied using any gas capable of forming excimers. Desirably, the gas includes a first gas component selected from the group consisting of He, Ne, Ar, Kr, and Xe and mixtures thereof. The gas may consist essentially of this first gas component. For example, the gas may be substantially pure Xe, to form $Xe_2$* excimers. Decay of these excimers yields ultraviolet radiation at a wavelength of 172 nm. In other embodiments, the gas includes a second gas component having a composition different from the composition of said first gas component. The second gas component may be a component which will form an excited species when contacted with the excimer formed from the first gas component. For example, the second gas component may be selected from the group consisting of nitrogen and hydrogen. In one system, the gas consists essentially of Ne as the first gas component and $H_2$ as the second gas component. This mixture can be excited to form $Ne_2$* excimers, and emits ultraviolet radiation at about 121 nm by a mechanism further explained in U.S. Pat. No. 6,282,222, the disclosure of which is incorporated by reference herein. Although neither the '222 patent nor the present invention is limited by any theory of operation, it is believed that this mechanism involves energy transfer from $Ne_2$* excimers to hydrogen, and emission from the resulting excited monatomic hydrogen. In another example, the gas consists essentially of Ar and $N_2$. The Ar preferably constitutes about 95–99 mole percent of the gas as, for example, about 1 bar Ar and about 20 millibars $N_2$. Upon excitation as discussed above, the system yields ultraviolet radiation at about 337 nm along with other wavelengths. Although the present invention is not limited by any theory of operation, it is believed that this occurs due to formation of $Ar_2$* excimers and transfer of energy from these excimers to $N_2$ thereby exciting the $N_2$ molecules, followed by decay of the excited $N_2$.

Where the gas includes one or more noble gases (He, Ne, Ar, Kr, and Xe) to form excimers of the noble gases (e.g., $Xe_2$*) certain impurities dramatically reduce the overall efficiency of excimer formation. In particular, these impurities include species which will form electronegative ions under the conditions prevailing in the system. Typically, these conditions include impact of electrons having energies on the order of about 2 to about 8 electron volts. The energies of the impacting electrons can be calculated from factors such as the applied potential and the mean free path which in turn is calculable from the gas pressure. As discussed in greater detail in the J. Appl. Phys. 2003 article, water vapor, ($H_2O$) is one such species. Other species which form negative ions under these conditions to a substantial extent include halogen containing species, $O_2$ and other oxygen containing species such as $CO_2$ and halogen-containing species. Most preferably, where noble gas excimer production is desired (as in an ultraviolet light source employing noble gas excimer emissions) the gas mixture contains about 10 ppm or less of all of these impurities taken together and particularly contains about 10 ppm or less water vapor. Lower impurity contents are even more desirable.

As mentioned above, excimer-forming methods and apparatus according to the present invention can be used to produce light; light is emitted upon decay of the excimers, most typically in the ultraviolet region of the spectrum.

Where the chamber has one or more walls which transmit light at the emission wavelength, the light can be used outside of the chamber. Alternatively, the materials to be treated by the light may be placed within the chamber containing the excimer-forming gas and the electrodes. In a further variant, the counter electrode may serve as a reflector, and may be configured to direct or focus the emitted light. The light can be applied directly to promote a chemical reaction. The light at 172 nm emitted by $Xe^*_2$ excimers interacts efficiently with oxygen to split $O_2$ into monatomic O, which recombines with other $O_2$ molecules to form ozone ($O_3$). High concentrations of ozone, on the order of 5% in room air, can be produced. Also, ultraviolet light can be used directly for purposes such as developing photo resist in semiconductor and other applications. In other applications, the ultraviolet light can be converted to visible or longer wavelength ultraviolet light by suitable phosphors disposed inside or outside the gas-containing chamber, so that the device acts as a lamp for producing visible or longer wavelength ultraviolet light. In still other applications, the radiation such as ultraviolet light emitted by the decaying excimers can be applied to promote other chemical reactions.

The pulsed potential yields light with pulsating intensity. Typically, the light intensity decays rapidly to zero between pulses. For many applications, such as ozone formation and photoresist development, the time average light intensity is the important parameter. The high excimer formation efficiency provides a high average light intensity. In other applications, the on and off times of the applied potential, and hence the on and off times of the light emission, can be selected to promote a particular result. For example, certain chemical reactions have particular time constants. Where radiation emitted by the excimers is applied to promote such reactions, the time between pulses of applied potential, and hence the time between pulses of radiation, can be selected to match such time constants. In a further variant, the pulsing radiation can be used to provide a stroboscopic effect. For example, where workpieces to be treated by the light are moved past the system in rapid succession, the pulses can be timed so that each pulse of radiation occurs when a new workpiece is positioned for exposure.

The particular configurations of the electrodes and chambers discussed above are merely exemplary. Other configurations, including those shown in the '089 patent, may be used. For example, the first electrode may include features such as one or more blades having sharp edges; multiple wires or multiple needles. Also, in the embodiments discussed above, free electrons are introduced into the excimer-forming gas by the localized ionization near the first electrodes. However, other sources of free electrons, such as an electron gun, may be employed. In an embodiment using an electron gun, the field within the excimer-forming gas may be a uniform field at a magnitude such that the electrons, once injected and accelerated by the field, will have an energy distribution such that a substantial number of electrons have energy above the energy required to excite atoms and thus form excimers, but the majority of electrons, and desirably all or nearly all of the electrons, have energy below the ionization energy of the gas. Stated another way, the field should be below the magnitude which produces arcing.

As these and other variations and combinations of the features discussed above can be utilized without departing from the invention as defined by the claims, the foregoing description of the preferred embodiments should be taken by way of illustration rather than by way of limitation of the invention as defined by the claims.

The invention claimed is:

1. A method of forming excimers in a gas comprising imposing an electric field within a gas by applying a pulsed electric potential including pulses about 100 microseconds or less in duration between a first electrode within the gas and a counter electrode remote from the first electrode, so that free electrons pass toward said counter electrode, said electric field being configured so that during pulses of said pulsed electric potential (i) within a region of said field said free electrons have an electron energy distribution such that at least some free electrons have energies equal to or greater than the excitation energy required to form the excimer; and (ii) within a region of said field, said free electrons have an electron energy distribution such that a substantial majority of free electrons have energies less than the ionization energy of the gas, whereby said free electrons excite the gas and form excimers without causing arcing.

2. A method as claimed in claim 1 wherein said pulsed electric potential consists essentially of pulses about 100 microseconds or less in duration.

3. A method as claimed in claim 1 wherein essentially all of the pulses of said pulsed electrical potential are of the polarity such that said first electrode is negative with respect to said counter electrode during said pulses.

4. A method as claimed in claim 3 wherein said pulsed potential is the only potential applied between said first electrode and said counter electrode.

5. A method as claimed in claim 1 wherein at least some of said pulses have rise times of about 10 microseconds or less.

6. A method as claimed in 1 wherein essentially all of said pulses have rise times of about 10 microseconds or less.

7. A method as claimed in claim 1 wherein said pulsed potential has a duty cycle of about 75% or less.

8. A method as claimed in claim 7 wherein said duty cycle is about 50% or less.

9. A method as claimed in any of the preceding claims wherein said first electrode includes an elongated wire and at least part of said counter electrode is a surface equidistant from said elongated wire.

10. A method as claimed in claim 9 wherein said elongated wire is substantially straight and defines a straight axis of elongation, and wherein said at least part of said counter electrode is in the form of at least a portion of a surface of revolution about said axis of elongation.

11. A method as claimed in claim 1 further comprising the step of utilizing electromagnetic radiation generated by decay of said excimers.

12. A method as claimed in claim 11 wherein said electromagnetic radiation includes ultraviolet light.

13. A method as claimed in claim 1 wherein said gas includes a first gas component selected from the group consisting of He, Ne, Ar, Kr, and Xe and mixtures thereof.

14. A method as claimed in claim 13 wherein said gas consists essentially of said first gas component.

15. A method as claimed in claim 13 wherein said gas includes a second gas component having a composition different from the composition of said first gas component.

16. A method as claimed in claim 15 wherein said second gas component is selected from the group consisting of nitrogen and hydrogen.

17. A method as claimed in claim 16 wherein said gas consists essentially of Ne and $H_2$.

18. A method as claimed in claim 16 wherein said gas consists essentially of Ar and $N_2$.

19. A method as claimed in claim 1 or claim 13 or claim 14 wherein said gas contains less than about 10 ppm of impurities capable of forming negatively-charged ions under the conditions prevailing in said regions.

20. A method as claimed in claim 1 or claim 13 or claim 14 wherein said gas contains less than about 10 ppm of water vapor.

21. A method as claimed in 19 further comprising the step of containing said gas inside a sealed chamber.

22. In a method of forming excimers in a gas comprising the steps of:

(a) providing free electrons in a gas; and (b) imposing an electric field within said gas so as to accelerate said free electrons, said electric field being configured so that (i) within a region of said field said free electrons have an electron energy distribution such that at least some free electrons have energies equal to or greater than the excitation energy required to form the excimer; and (ii) within a region of said field, said free electrons have an electron energy distribution such that a substantial majority of free electrons have energies less than the ionization energy of the gas, whereby said free electrons excite the gas and form excimers without causing arcing, the improvement wherein said gas contains less than about 10 ppm of impurities selected from the group consisting of oxygen-containing species and halogen-containing species.

23. In a method of forming excimers in a gas comprising the steps of:

(a) providing free electrons in a gas; and (b) imposing an electric field within said gas so as to accelerate said free electrons, said electric field being configured so that (i) within a region of said field said free electrons have an electron energy distribution such that at least some free electrons have energies equal to or greater than the excitation energy required to form the excimer; and (ii) within a region of said field, said free electrons have an electron energy distribution such that a substantial majority of free electrons have energies less than the ionization energy of the gas, whereby said free electrons excite the gas and form excimers without causing arcing, the improvement wherein said gas contains less than about 10 ppm of water vapor.

24. In a method of forming excimers in a gas comprising the steps of:

(a) providing free electrons in a gas; and (b) imposing an electric field within said gas so as to accelerate said free electrons, said electric field being configured so that (i) within a region of said field said free electrons have an electron energy distribution such that at least some free electrons have energies equal to or greater than the excitation energy required to form the excimer; and (ii) within a region of said field, said free electrons have an electron energy distribution such that a substantial majority of free electrons have energies less than the ionization energy of the gas, whereby said free electrons excite the gas and form excimers without causing arcing, the improvement wherein said gas contains less than about 10 ppm of impurities capable of forming negatively-charged ions in said regions.

25. A method as claimed in claim 24 or claim 22 or claim 23 wherein said step of providing an electric field includes providing a first electrode within the gas and providing a counter electrode remote from the first electrode.

26. A method as claimed in claim 25 wherein said first electrode is at a negative potential with respect to the counter electrode during at least a portion of the time.

27. A method as claimed in 26 wherein said gas consists essentially of Xe.

28. A method as claimed in claim 24 or claim 22 or claim 23 wherein said gas includes a first gas component selected from the group consisting of He, Ne, Ar, Kr, and Xe and mixtures thereof.

29. A method as claimed in claim 28 wherein said gas consists essentially of said first gas component.

30. Apparatus as claimed in claim 29 further comprising the step of utilizing electromagnetic radiation generated by decay of said excimers.

31. Apparatus as claimed in claim 30 wherein said electromagnetic radiation includes ultraviolet light.

32. Apparatus for forming excimers in a gas comprising:

(a) a chamber for holding an excimer-forming gas;

(b) a first electrode disposed within said chamber;

(c) a counter electrode within said chamber remote from said first electrode; and (d) a potential-applying circuit connected to said first electrode and to said counter electrode, said circuit being adapted to apply a pulsed potential between said electrodes so that during said pulses, the potential imposes an electric field within said gas so as to provide and accelerate free electrons, said electric field being configured so that during said pulses (i) within a region of said field said free electrons have an electron energy distribution such that at least some free electrons have energies equal to or greater than the excitation energy required to form the excimer; and (ii) within a region of said field, said free electrons have an electron energy distribution such that a substantial majority of free electrons have energies less than the ionization energy of the gas, said potential-applying circuit being adapted to apply said pulses so that at least some of said pulses are about 100 microseconds or less in duration.

33. Apparatus as claimed in claim 32 wherein said potential-applying circuit is adapted to apply said pulses so that substantially all of said pulses are about 100 microseconds or less in duration.

34. Apparatus as claimed in claim 33 wherein said potential-applying circuit is adapted to apply said pulses so that at least some of said pulses have rise times of about 10 microseconds or less.

35. Apparatus as claimed in 33 wherein said potential-applying circuit is adapted to apply said pulses so that wherein essentially all of said pulses have rise times of about 10 microseconds or less.

36. Apparatus as claimed in claim 33 wherein said potential-applying circuit is adapted to apply said pulses so that said pulsed potential has a duty cycle of about 75% or less.

37. Apparatus as claimed in claim 36 wherein said potential-applying circuit is adapted to apply said pulses so that said duty cycle is about 50% or less.

38. Apparatus as claimed in claim 32 wherein said first electrode includes an elongated wire and at least part of said counter electrode is a surface equidistant from said elongated wire.

39. Apparatus as claimed in claim 38 wherein said elongated wire is substantially straight and defines a straight axis of elongation, and wherein said at least part of said counter electrode is in the form of at least a portion of a surface of revolution about said axis of elongation.

40. Apparatus as claimed in any of claims 32–39 wherein said first electrode includes electrode structure defining a plurality of pointed regions.

41. Apparatus as claimed in claim 32 wherein said gas includes a first gas component selected from the group consisting of He, Ne, Ar, Kr, and Xe and mixtures thereof.

42. Apparatus as claimed in claim 41 wherein said gas consists essentially of said first gas component.

43. Apparatus as claimed in claim 32 wherein said gas includes a second gas component having a composition different from the composition of said first gas component.

44. Apparatus as claimed in claim 43 wherein said second gas component is selected from the group consisting of nitrogen and hydrogen.

45. Apparatus as claimed in claim 43 wherein said gas consists essentially of Ne and $H_2$.

46. Apparatus as claimed in claim 32 wherein said gas contains less than about 10 ppm of impurities capable of forming negatively-charged ions under the conditions prevailing in said regions.

47. Apparatus as claimed in claim 32 wherein said chamber has a wall transparent to electromagnetic radiation emitted by decay of said excimers.

48. Apparatus as claimed in claim 32 wherein said potential-applying circuit includes a control circuit arranged to detect arcing and to modify operation of the potential-applying circuit in response to arcing.

49. Apparatus as claimed in claim 48 wherein said control circuit is arranged to momentarily interrupt operation of the potential-applying circuit in response to arcing.

* * * * *

UNITED STATES PATENT AND TRADEMARK OFFICE

CERTIFICATE OF CORRECTION

PATENT NO. : 7,199,374 B2 
APPLICATION NO. : 11/215759
DATED : April 3, 2007
INVENTOR(S) : Manfred Salvermoser and Daniel E. Murnick It is certified that error appears in the above-identified patent and that said Letters Patent is hereby corrected as shown below:

Column 2, line 13, “imposes an electric” should read -- the circuit imposes an electric --.
Column 3, line 44, “includes plurality” should read -- includes a plurality --.
Column 5, line 18, “atoms are” should read -- atoms is --.
Column 5, line 26, “increases,” should read -- increase, --.
Column 5, line 30, “again to and” should read -- again to ε* and --.
Column 5, line 45, “causes” should read -- cause --.
Column 6, line 33, “time is” should read -- time, is --.
Column 7, line 46, “embodiment, field” should read -- embodiment, the field --.
Column 7, line 52, “6 kV is” should read -- 6 kV, is --.
Column 9, line 14, “photo resist” should read -- photoresist --.
Column 10, line 9, “field said” should read -- field, said --.
Column 11, line 13, “field said” should read -- field, said --.
Column 11, line 31, “field said” should read -- field, said --.
Column 11, line 47, “field said” should read -- field, said --.
Column 12, line 1, “in 26” should read -- in claim 26 --.
Column 12, line 26, “field said” should read -- field, said --.

Signed and Sealed this

First Day of April, 2008

JON W. DUDAS
*Director of the United States Patent and Trademark Office*